United States Patent [19]

Shockovsky

[11] 4,151,768

[45] May 1, 1979

[54] APPARATUS AND METHOD FOR FORMING TEMPLATES

[76] Inventor: Robert E. Shockovsky, 4016 Landside Dr., Louisville, Ky. 40220

[21] Appl. No.: 902,662

[22] Filed: May 4, 1978

[51] Int. Cl.[2] ..... B26F 1/38

[52] U.S. Cl. ..... 83/33; 83/50; 83/451; 83/467 R; 83/553; 83/522; 83/685

[58] Field of Search ..... 83/33, 50, 55, 451, 83/467, 553, 685, 522

[56] References Cited

U.S. PATENT DOCUMENTS

| | | | |
|---|---|---|---|
| 2,307,617 | 1/1943 | Braun | 83/33 |
| 2,537,540 | 1/1951 | Messenger | 83/33 |
| 2,557,797 | 6/1951 | Rand | 83/451 X |
| 3,198,047 | 8/1965 | Munz | 83/451 X |
| 3,229,557 | 1/1966 | Kapilow | 83/451 |

*Primary Examiner*—Frank T. Yost
*Attorney, Agent, or Firm*—Price and Caslin

[57] ABSTRACT

An adjustable die assembly is shown for forming a template having a plurality of holes each having a medial lug portion. The die assembly is mounted in a base member that has a graduated dial plate. The template is first provided with a plurality of starter holes. The die has a post surrounded by an annular recess except for a medial lug portion. The die is first set at a particular angular relationship to the dial plate. A template hole to be processed is fitted over the post. The base member includes an adjustable cross bar for alignment of the template with respect to a datum plane. A punch is then assembled on the die post and passed through the template for forming the holes with a medial lug portion in various angular positions.

12 Claims, 13 Drawing Figures

APPARATUS AND METHOD FOR FORMING TEMPLATES

CROSS-REFERENCE TO RELATED APPLICATION

A copending application Ser. No. 756,121 entitled "Dial Setting Device" was filed by the present applicant on Jan. 3, 1977.

This earlier application describes and shows a template having a plurality of holes with medial lug portions, where the template is one modification of several dial setting devices. The present invention relates to both apparatus and method for making such templates.

BACKGROUND OF THE INVENTION

1. Field of the Invention:

This invention relates to punch and die assemblies for making holes in templates, and particularly an adjustable die assembly for making a template having a plurality of holes each with a medial lug of various angular positions.

2. Description of the Prior Art:

It is known to have single punch and die sets to form holes of any shapes in templates, but there appears to be an absence in the prior art of adjustable die assemblies of precision quality for use in forming holes with variable medial lugs that have angular positions that are interrelated.

OBJECTS OF THE PRESENT INVENTION

The principal object of the present invention is to provide both the apparatus and method of precision quality for forming a template with a plurality of holes each having a medial lug portion, where the template is oriented in a fixed relationship to a graduated dial of the apparatus, A further object of the present invention is to provide a punch and adjustable die assembly for making templates of the class described, with the use of an adjustable alignment means for engaging the template in any of its positions on the die assembly so there is a fixed relationship between the position of the template and the graduated dial.

A further object of the present invention is to provide a punch and adjustable die assembly of the class described with means for maintaining a fixed relation between an edge of the template and the graduated dial of the base member that supports the adjustable die.

SUMMARY OF THE INVENTION

The present invention provides a punch and adjustable die assembly as well as a method of working on a template having a plurality of starting holes so as to provide the holes with a medial lug at various angular relationships. A base member supports the die assembly for angular adjustment. A graduated dial is carried by the base member so the die may be adjusted with relation to the dial at various angular positions. The die includes a post over which each of the starter holes of the template is placed in succession. The die has an annular recess at the base of the post except for a medial lug portion. The base member also has an adjustable alignment means that is movable toward and away from the die post and is engageable with the template in all of its positions for maintaining the template at a fixed relationship with respect to the graduated dial. The die post receives a punch which is aligned therewith, and the punch has a cutting surface to match that of the die for passing through the template.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
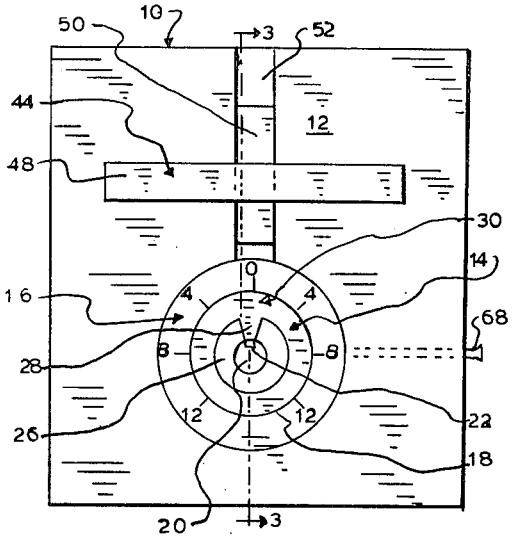
FIG. 1 is a top plan view of a punch and adjustable die assembly according to the present invention showing the adjustable cross bar which is movable toward and away from the die post.

Turning now to a consideration of the drawings and, in particular, to the top plan view of FIG. 1, there is shown a punch and adjustable die assembly 10 of the present invention comprising a base member 12 which supports the adjustable die assembly 14 therein. The base member 12 supports a fixed graduated dial 16 which is concentric with the die assembly 14. The graduations or indicia of the dial 16 include a central "0" position and a left hand and a right hand scale, which for illustrative purposes are marked off in segments of "4". It should be understood that the kinds of graduations are not critical to the present invention.

Figure 3:
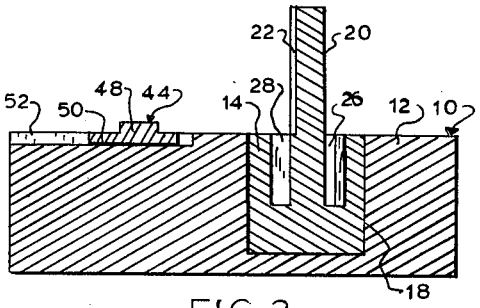
FIG. 3 is a side cross-sectional elevational view of the base member and adjustable die taken on the discontinuous line 3—3 of FIG. 1 showing in particular the annular recess that surrounds the die post except for the medial lug portion.
Figure 5:
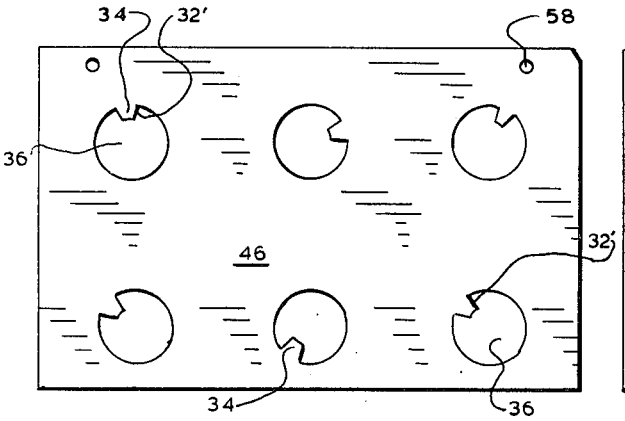
FIG. 5 is another top plan view of the template of FIG. 4 after it has been processed by the apparatus and method of the present invention showing where each starter hole has been enlarged to include a medial lug portion at various angular relationships.
Figure 7:
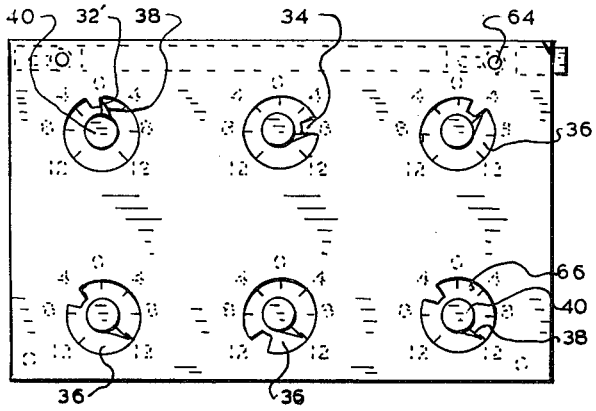
FIG. 7 is a top plan view of the control panel of FIG. 6 with the holes of the finished template of FIG. 5 fitted over the knobs to show the interrelation between the pointers of the knobs and the medial lug portions of the holes of the template for setting positions of the knobs to desired angular relationships.
Figure 12:
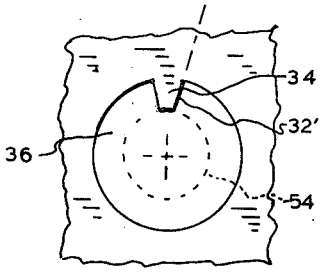
FIG. 12 is an enlarged fragmentary view of one of the finished template holes of FIG. 5 showing the original starter hole in dotted lines, and the enlarged nature of the finished hole with its medial lug.

The die assembly 14 is a circular cylindrical member which fits into a cylindrical recess 18 in the base member 12 in close fitting relationship, as is clear from FIG. 3. The die assembly 14 has a central, vertical post 20 with a longitudinal keyway 22. As best seen in FIGS. 1 and 3, there is an annular recess 26 surrounding the post, except for a medial lug portion 28. Notice that FIG. 3 is taken along the irregular line 3—3 of FIG. 1 which extends along the left side of the medial lug 28 in FIG. 1. Thus in FIG. 3, the medial lug 28 is shown in full lines. The top face of the die assembly 14 has an index pointer 30 for aligning the die with the angular graduations of the dial plate 16. This index pointer 30 is designed to be in alignment with the right hand face 32 of the lug portion 28, as is best seen in FIG. 1. This right hand face 32 serves to form the right hand face 32' of the medial lug portion 34 of the finished hole 36, which is illustrated in FIGS. 5 and 12. It is this right hand face 32' which is acted upon the lug 38 of the knob 40, as is best seen in FIG. 7.

Figure 2:
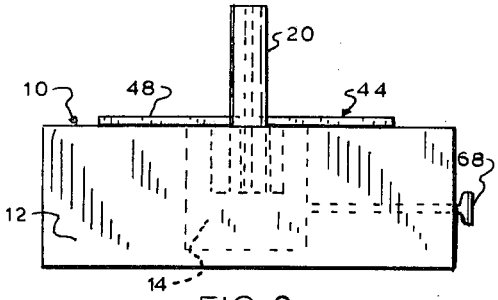
FIG. 2 is a front elevational view of the assembly of FIG. 1 showing the relative natures of the die post and cross bar, as well as the snubbing or locking means on the base member for retarding the angular movement of the die.
Figure 4:
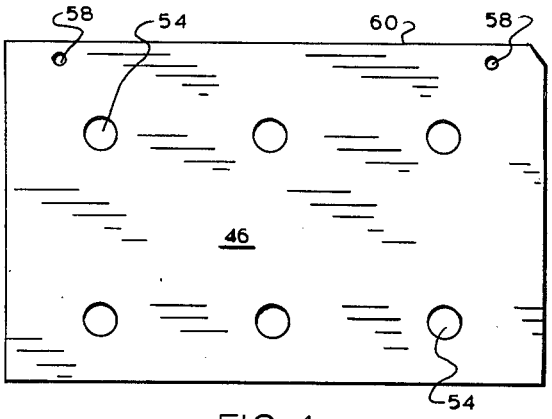
FIG. 4 is a top plan view of a template that is to be worked on by the punch and adjustable die assembly of the present invention, where the template is shown having a plurality of starter holes.

Associated with the die assembly 14 is an adjustable alignment means 44 for aligning the template 46 of FIG. 4 on the post 20 of FIGS. 1–3. This alignment means 44 comprises a transverse cross bar 48 that is attached to a slide member 50 that moves within an elongated groove 52 in the top surface of the base member 12. This groove 52 is in direct longitudinal alignment with the "0" setting on the graduated dial 16. Thus the transverse cross bar 48 is at a right angle to the "0" setting of the dial 16. The slide member is free to move within the groove 52, thus the cross bar is adjustable with respect to the post 20.

Looking at FIG. 4, the template 46 is a flat sheet having a plurality of starter holes 54 of uniform size, that are each adapted to slip down over the post 20 of the die assembly 14. The template 46 also has a pair of positioning holes 58 along one edge 60 of the template.

Figure 6:
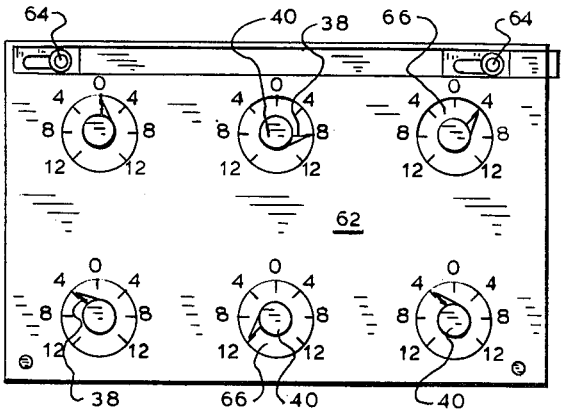
FIG. 6 is a top plan view of a control panel having a plurality of control knobs and a fixed graduated dial associated with each knob, where each knob has a pointer.

The template 46 is to be fashioned to cooperate with the control panel 62 that is shown in top plan view of FIG. 6. Notice the pair of positioning pins 64 for receiving the positioning holes 58 thereover. The control panel 62 is shown with a series of six control knobs 40 arranged in two lines of three each. Each knob cooperates with a small graduated dial 66. The graduated dial 16 of the adjustable die assembly 10 has been fashioned to conform to the dials 66 of the control panel. If the dials 66 were to be changed, the dial 16 would be changed to conform.

By comparing FIGS. 4 and 6, it should be appreciated that the six starter holes 54 of the template of FIG. 4 have generally the same centers as the six knobs 40 of the control panel of FIG. 6.

Figure 9:
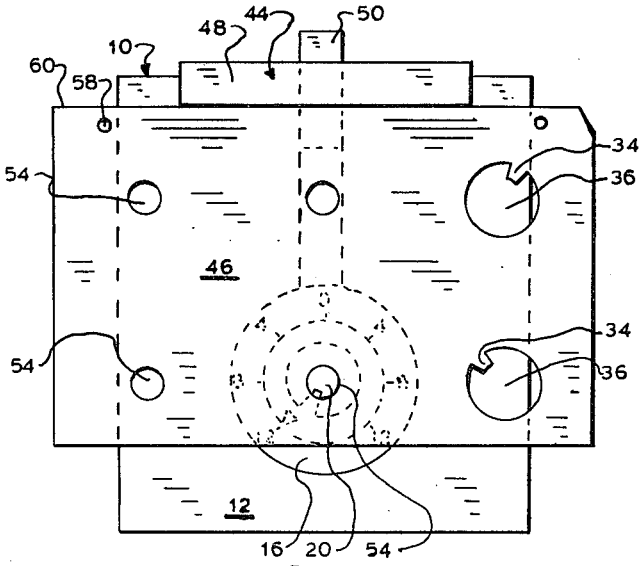
FIG. 9 is a top plan view of the punch and die assembly of FIG. 1 where the die is rotated into the left hand "12" digit angle position, and the middle bottom starter hole of the template of FIG. 4 is positioned over the die post, and the cross bar is shown engaging the top edge of the template.
Figure 13:
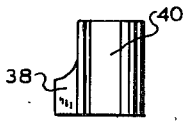
FIG. 13 is a side elevational view of one of the knobs of the control panel of FIG. 6.

Looking at FIG. 9, the die assembly 14 is shown adjusted counterclockwise to the left hand "12" setting. The center starter hole 54 of the lower line of three holes of the template is shown positioned over the die post 20 Moreover, the cross bar 48 is moved flush against the edge 60 of the template so as to align the template with respect to the "0" setting of the dial 16. Notice that the two right hand holes of the template are finished holes 36 having medial lugs 34.

Looking at FIGS. 1 and 2, the base member 12 is shown with a snubbing means 68 in the form of a turn screw that extends from one side of the base and adjustably engages the die assembly 14. The turn screw may be turned to lock the die in place, or turned to release the die. Variations in between a locking position and a release position give different degrees of snubbing action.

Figure 10:
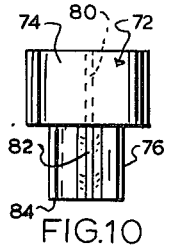
FIG. 10 is a side elevational view of the punch which slips down over the die post for passing through the template into the die.
Figure 11:
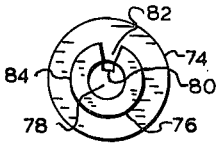
FIG. 11 is a bottom plan view of the punch of FIG. 10 showing its bottom cutting edge which fits into the die assembly, as best seen in FIG. 1.
Figure 8:
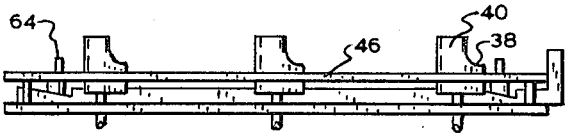
FIG. 8 is a side elevational view of the control panel and template combination of FIG. 7.

One important part which hasn't been described yet is the punch 72 that is shown in FIGS. 10 and 11. The punch has a head 74 and a shank 76. The punch has a longitudinal circular bore 78 for mating with the die post 20. The portion of the bore 78 within the head 74 is provided with a longitudinal key 80 for mating with the longitudinal keyway 22 of the die post 20. Moreover, shank portion 76 has an inwardly tapered longitudinal slot 82 that is adapted to mate with the medial lug portion 28 of the die assembly 14. Thus the cutting edge of the punch 72 is represented by the peripheral edge 84 of the lower portion of the shank 76, including the two tapered surfaces that cut out the tapered sides of the medial lug portion 34, as shown in FIG. 12.

The punch 72 is first slipped over the die post 20 as seen in FIG. 9. Then a hammer blow is applied to the head 74 of the punch, and the punch will be driven through the template to form the finished hole 36, that is shown at the center of the three holes in the lower set of the template.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An adjustable punch and die assembly for forming in a template a plurality of holes with various medial lugs, said assembly comprising:

a base member having a top table surface with a recess having an angularly adjustable die positioned therein, a fixed dial plate having a series of angular graduations surrounding the recess and cooperating with the die;

the adjustable die having a vertical post over which one of a plurality of holes in a template is adapted to slip thereover, an annular area of the die surrounding the base of the post being recessed except for a medial lug portion, and a die index pointer carried by the die and cooperating with the dial plate for positioning the die at a predetermined angle;

an adjustable alignment means supported on the base member and movable toward and away from the die and adapted for aligning a template supported on the die relative to a datum plane;

and an annular punch having a vertical bore for mating with the post of the die member, the lower portion of the punch being adapted to mate into the recessed annular area of the said die, the punch having a cut-out portion to prevent interference with the medial lug portion of the die so that the punch is capable of forming the holes in the template with medial lugs at predetermined angular relationships.

2. The invention of claim 1 wherein the said adjustable alignment means comprises a cross bar which has a fixed angular relationship with respect to at least one of the angular graduations of the said dial plate.

3. The invention of claim 2 wherein the cross bar includes a guide bar, and the base member has a guide means cooperating with the guide bar for restricting the movement of the cross bar.

4. The invention of claim 3 wherein the said guide means comprises an elongated groove for receiving the guide bar therein for relative sliding movement.

5. The invention of claim 1 wherein the said recess in the base member is cylindrical and the adjustable die is likewise cylindrical to mate in the recess for relative turning movement in an adjusting mode.

6. The invention of claim 5 with the addition of snubbing means between the die and the base member to retard the relative movement therebetween.

7. The invention of claim 1 wherein the said die post has longitudinal indexing means oriented with respect to the said die index pointer, and the said bore of the punch has complementary indexing means with respect to the post indexing means.

8. A punch and adjustable die assembly for use with a template having a plurality of starting holes so as to provide at least some of the holes with a medial lug at various angular relationships, said assembly comprising:

a base member having an angularly adjustable die positioned therein, with a graduated dial means cooperating therewith;

the adjustable die having a vertical post adapted to receive a hole of the template thereover, an annular area of the die surrounding the post being recessed except for a medial lug portion, and a die indexing means carried by the die and cooperating with the graduated dial means for adjusting the die to predetermined angular relationships;

an adjustable alignment means supported on the base member and guided for movement toward and away from the die post and adapted to align a template plate supported on the die post relative to a datum plane;

and a punch having a bore for cooperation with the die post, the punch having a transverse cutting cross-section that matches the annular recessed area of the die minus the said medial lug portion.

9. The invention of claim 8 wherein the adjustable alignment means comprises a cross bar which has a fixed angular relationship with respect to the graduated dial means.

10. The invention of claim 9 wherein the said cross bar includes a guide bar that slides with respect to a guide means of the base member.

11. The method of making a template with a plurality of holes and to provide at least some of the holes with a medial lug at various angular relationships, which method comprises the steps of:

forming a plurality of starting holes in the template, and providing an adjustable die assembly with a base member for receiving the die therein, and providing the base member with a graduated dial plate and the adjustable die with a cooperating indexing means for setting the die to various angular relationships, and providing the die with a post to receive a hole of the template in succession thereover, and providing the die with an annular recess surrounding the die post except for a medial lug portion, and providing the base member with an adjustable alignment means that is guided for movement toward and away from the die post and cooperates with the template when assembled over the die post to engage and align the template relative to a fixed datum plane, and fitting a punch that mates into the recess of the die over the die post for passing through the template and creating the medial lug portion for each hole in succession.

12. The method of making a template with a plurality of holes and to provide the holes with a medial lug at variable angular relationships, which method comprises the steps of:

forming a plurality of starting holes in the template, and providing a base member with an adjustable die assembly and with a graduated dial plate for setting the die at various angular postions, and in succession placing a hole of the template over a post of the die and, providing the base member with an adjustable alignment means that is guided for movement toward and away from the die post and cooperates with the template when assembled over the die post to engage and align the template relative to a fixed datum plane, and fitting a punch over the die post for passing through the template and creating the desired medial lug for each hole in succession.

* * * * *